US008494197B2

(12) United States Patent
Polinske et al.

(10) Patent No.: US 8,494,197 B2
(45) Date of Patent: Jul. 23, 2013

(54) ANTENNAS FOR CUSTOM FIT HEARING ASSISTANCE DEVICES

(75) Inventors: Beau Jay Polinske, Minneapolis, MN (US); Jorge F. Sanguino, Hopkins, MN (US); Jay Rabel, Shorewood, MN (US); Jeffrey Paul Solum, Deephaven, MN (US); Michael Helgeson, New Richmond, WI (US); David Tourtelotte, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 808 days.

(21) Appl. No.: 12/340,600

(22) Filed: Dec. 19, 2008

(65) Prior Publication Data

US 2010/0158295 A1 Jun. 24, 2010

(51) Int. Cl.
*H04R 25/00* (2006.01)
*H01Q 7/00* (2006.01)

(52) U.S. Cl.
USPC ..... 381/315; 381/324; 343/866

(58) Field of Classification Search
USPC ..... 381/315
See application file for complete search history.

(56) References Cited

U.S. PATENT DOCUMENTS

| | | | | |
|---|---|---|---|---|
| 3,601,550 | A | 8/1971 | Spracklen | |
| 5,390,254 | A | 2/1995 | Adelman | |
| 5,734,976 | A | 3/1998 | Bartschi et al. | |
| 5,808,587 | A | 9/1998 | Shima | |
| 6,041,128 | A | 3/2000 | Narisawa et al. | |
| 6,041,129 | A | 3/2000 | Adelman | |
| 6,061,037 | A | 5/2000 | Brouwers et al. | |
| 6,205,227 | B1 | 3/2001 | Mahoney et al. | |
| 6,249,256 | B1 | 6/2001 | Luxon et al. | |
| 6,307,945 | B1 | 10/2001 | Hall | |
| 6,380,896 | B1 | 4/2002 | Berger et al. | |
| 6,456,720 | B1 * | 9/2002 | Brimhall et al. | 381/324 |
| 6,473,512 | B1 | 10/2002 | Juneau et al. | |
| 6,501,437 | B1 | 12/2002 | Gyorko et al. | |
| 6,546,109 | B1 | 4/2003 | Gnecco et al. | |
| 6,597,320 | B2 * | 7/2003 | Maeda et al. | 343/718 |
| 6,603,440 | B2 | 8/2003 | Howard | |
| 6,674,869 | B2 | 1/2004 | Paczkowski | |
| 7,142,682 | B2 | 11/2006 | Mullenborn et al. | |

(Continued)

FOREIGN PATENT DOCUMENTS

| | | | |
|---|---|---|---|
| DE | 10236469 | B3 | 2/2004 |
| EP | 0382675 | A1 | 8/1990 |

(Continued)

OTHER PUBLICATIONS

"U.S. Appl. No. 11/357,751 Response filed May 18, 2009 to Final Office Action mailed Feb. 17, 2009", 9 pgs.

(Continued)

*Primary Examiner* — Jerome Jackson, Jr.
(74) *Attorney, Agent, or Firm* — Schwegman, Lundberg & Woessner, P.A.

(57) ABSTRACT

An embodiment of a hearing assistance device comprises an enclosure that includes a faceplate and a shell attached to the faceplate, a power source, a flex antenna, a transmission line connected to the flex antenna, and radio circuit connected to the transmission line and electrically connected to the power source. The flex antenna has a shape of at least a substantially complete loop around the power source, and maintains separation from the power source.

28 Claims, 16 Drawing Sheets

U.S. PATENT DOCUMENTS

| | | | | |
|---|---|---|---|---|
| 7,265,721 | B2 | 9/2007 | Fujii et al. | |
| 7,289,069 | B2 | 10/2007 | Ranta | |
| 7,315,290 | B2 | 1/2008 | Harada et al. | |
| 7,426,279 | B2 | 9/2008 | Cochran et al. | |
| 7,443,992 | B2 | 10/2008 | Fideler | |
| 7,450,078 | B2 * | 11/2008 | Knudsen et al. | 343/718 |
| 7,454,027 | B2 * | 11/2008 | Sorensen | 381/322 |
| 7,593,538 | B2 | 9/2009 | Polinske | |
| 7,659,469 | B2 * | 2/2010 | Belli | 84/411 R |
| 7,742,614 | B2 * | 6/2010 | Christensen et al. | 381/324 |
| 7,881,486 | B1 | 2/2011 | Killion et al. | |
| 8,180,080 | B2 | 5/2012 | Polinske | |
| 2001/0007050 | A1 | 7/2001 | Adelman | |
| 2002/0037756 | A1 | 3/2002 | Jacobs et al. | |
| 2002/0090099 | A1 | 7/2002 | Hwang | |
| 2003/0122713 | A1 | 7/2003 | Morris | |
| 2004/0027296 | A1 | 2/2004 | Gerber | |
| 2004/0028251 | A1 | 2/2004 | Kasztelan et al. | |
| 2004/0044382 | A1 | 3/2004 | Ibrahim | |
| 2004/0176815 | A1 | 9/2004 | Janzig et al. | |
| 2004/0196190 | A1 | 10/2004 | Mendolia et al. | |
| 2005/0099341 | A1 | 5/2005 | Zhang et al. | |
| 2005/0100183 | A1 | 5/2005 | Ballisager et al. | |
| 2005/0244024 | A1 | 11/2005 | Fischer et al. | |
| 2006/0055531 | A1 | 3/2006 | Cook et al. | |
| 2006/0145931 | A1 | 7/2006 | Ranta | |
| 2006/0227989 | A1 | 10/2006 | Polinske | |
| 2007/0080889 | A1 | 4/2007 | Zhang | |
| 2007/0086610 | A1 | 4/2007 | Niederdrank | |
| 2007/0229369 | A1 | 10/2007 | Platz | |
| 2008/0095387 | A1 | 4/2008 | Niederdrank et al. | |
| 2008/0150816 | A1 | 6/2008 | Rahola et al. | |
| 2008/0272980 | A1 | 11/2008 | Adel et al. | |
| 2008/0287084 | A1 | 11/2008 | Krebs et al. | |
| 2009/0041285 | A1 | 2/2009 | Parkins et al. | |
| 2009/0136068 | A1 | 5/2009 | Koo et al. | |
| 2009/0214064 | A1 | 8/2009 | Wu et al. | |
| 2009/0226786 | A1 | 9/2009 | Selcuk et al. | |
| 2010/0074461 | A1 | 3/2010 | Polinske | |
| 2010/0158291 | A1 | 6/2010 | Polinske et al. | |
| 2010/0158293 | A1 | 6/2010 | Polinske et al. | |
| 2010/0158294 | A1 | 6/2010 | Helgeson et al. | |
| 2010/0171667 | A1 | 7/2010 | Knudsen | |
| 2011/0228947 | A1 | 9/2011 | Killion et al. | |

FOREIGN PATENT DOCUMENTS

| | | | |
|---|---|---|---|
| EP | 0594375 | A2 | 4/1994 |
| EP | 1250026 | A1 | 10/2002 |
| EP | 1389035 | A1 | 2/2004 |
| EP | 1460712 | A1 | 9/2004 |
| EP | 1587344 | A2 | 10/2005 |
| EP | 1851823 | B1 | 8/2006 |
| EP | 1708306 | A1 | 10/2006 |
| EP | 1821571 | A1 | 8/2007 |
| JP | 02300894 | A | 12/1990 |
| JP | 2002238098 | A | 8/2002 |
| JP | 2002238100 | A | 8/2002 |
| WO | WO-9213430 | A1 | 8/1992 |
| WO | WO-9306666 | A1 | 4/1993 |
| WO | WO-9731431 | A1 | 8/1997 |
| WO | WO-9949815 | A1 | 10/1999 |
| WO | WO-0143497 | A1 | 6/2001 |
| WO | WO-0173864 | A2 | 10/2001 |
| WO | WO-0173865 | A2 | 10/2001 |
| WO | WO-0173868 | A2 | 10/2001 |
| WO | WO-0173870 | A2 | 10/2001 |
| WO | WO-0173883 | A2 | 10/2001 |
| WO | WO-0173957 | A2 | 10/2001 |
| WO | WO-2004093002 | A1 | 10/2004 |
| WO | WO-2008023860 | A1 | 2/2008 |

OTHER PUBLICATIONS

"U.S. Appl. No. 11/357,751, Response filed Nov. 24, 2008 to Non Final Office Action mailed May 23, 2008", 13 pgs.
"U.S. Appl. No. 11/357,751 Final Office Action mailed Feb. 17, 2009", 11 pgs.
"U.S. Appl. No. 11/357,751, Non-Final Office Action mailed May 23, 2008", 9 pgs.
"U.S. Appl. No. 11/357,751, Non-Final Office Action Mailed Aug. 28, 2007", 9 pgs.
"U.S. Appl. No. 11/357,751, Notice of Allowance mailed Aug. 5, 2009", 7 Pgs.
"U.S. Appl. No. 11/357,751, Preliminary Amendment mailed Aug. 28, 2006", 6 pgs.
"U.S. Appl. No. 11/357,751, Response filed Feb. 28, 2008 to Non-final Office Action mailed Aug. 28, 2007", 10 pgs.
"International Application Serial No. 06251644.8, European Office Action mailed Mar. 11, 2008", 4 pgs.
Chen, W T, et al,, "Numerical computation of the EM coupling between a circular loop antenna and a full-scale human-body model", *IEEE Transactions on Microwave Theory and Techniques*, 46(10), (Oct. 1998), 1516-1520.
"U.S. Appl. No. 12/340,600, Preliminary Amendment filed Apr. 6, 2009", 7 pgs.
"European Application Serial No. 09252775.3, Extended European Search Report mailed Apr. 19, 2010", 6 pgs.
"U.S. Appl. No. 12/340,591, Non Final Office Action mailed Sep. 12, 2011", 7 pgs.
"U.S. Appl. No. 12/340,591, Response filed Jan. 12, 2012 to Non Final Office Action mailed Sep. 12, 2011", 7 pgs.
"U.S. Appl. No. 12/340,604 , Response filed Jan. 11, 2012 to Non Final Office Action mailed Oct. 11, 2011", 10 pgs.
"U.S. Appl. No. 12/340,604, Non Final Office Action mailed Oct. 11, 2011", 11 pgs.
"U.S. Appl. No. 12/550,821, Non Final Office Action mailed Sep. 1, 2011", 9 pgs.
"U.S. Appl. No. 12/638,720, Non Final Office Action mailed Oct. 17, 2011", 14 pgs.
"U.S. Appl. No. 12/638,720, Response filed Jan. 17, 2012 to Non Final Office Action mailed Oct. 17, 2011", 9 pgs.
"European Application Serial No. 09252796.9, Extended European Search Report mailed May 24, 2011", 6 Pgs.
"European Application Serial No. 09252830.6, Extended European Search Report mailed May 24, 2011", 6 pgs.
"European Application Serial No. 09252830.6, Extended Search Report Response filed Dec. 15, 2011", 9 pgs.
"U.S. Appl. No. 12/340,591, Final Office Action mailed Mar. 14, 2012", 7 pgs.
"U.S. Appl. No. 12/340,591, Response filed Aug. 14, 2012 to Final Office Action mailed Mar. 14, 2012", 11 pgs.
"U.S. Appl. No. 12/340,604 , Response filed Aug. 1, 2012 to Final Office Action mailed Mar. 1, 2012", 9 pgs.
"U.S. Appl. No. 12/340,604, Final Office Action Mailed Mar. 1, 2012", 14 pgs.
"U.S. Appl. No. 12/550,821, Notice of Allowance mailed Mar. 19, 2012", 9 pgs.
"U.S. Appl. No. 12/550,821, Notice of Allowance mailed Apr. 10, 2012", 7 pgs.
"U.S. Appl. No. 12/550,821, Response filed Mar. 1, 2012 to Non Final Office Action mailed Sep. 1, 2011", 6 pgs.
"U.S. Appl. No. 12/638,720 , Response filed Aug. 1, 2012 to Final Office Action mailed Mar. 2, 2012", 9 pgs.
"U.S. Appl. No. 12/638,720, Final Office Action mailed Mar. 2, 2012", 17 pgs.

* cited by examiner

ANTENNAS FOR CUSTOM FIT HEARING ASSISTANCE DEVICES

TECHNICAL FIELD

This application relates generally to antennas, and more particularly to antennas for hearing assistance devices.

BACKGROUND

Examples of hearing assistance devices, also referred to herein as hearing instruments, include both prescriptive devices and non-prescriptive devices. Examples of hearing assistance devices include, but are not limited to, hearing aids, headphones, assisted listening devices, and earbuds.

Hearing instruments can provide adjustable operational modes or characteristics that improve the performance of the hearing instrument for a specific person or in a specific environment. Some of the operational characteristics are volume control, tone control, and selective signal input. These and other operational characteristics can be programmed into a hearing aid. A programmable hearing aid can be programmed using wired or wireless communication technology.

Generally, hearing instruments are small and require extensive design to fit all the necessary electronic components into the hearing instrument or attached to the hearing instrument as is the case for an antenna for wireless communication with the hearing instrument. The complexity of the design depends on the size and type of hearing instrument. For completely-in-the-canal (CIC) hearing aids, the complexity can be more extensive than for in-the-ear (ITE) hearing aids, behind-the-ear (BTE) or on-the-ear (OTE) hearing aids due to the compact size required to fit completely in the ear canal of an individual.

Systems for wireless hearing instruments have been proposed, in which information is wirelessly communicated between hearing instruments or between a wireless accessory device and the hearing instrument. Due to the low power requirements of modern hearing instruments, the system has a minimum amount of power allocated to maintain reliable wireless communication links. Also the small size of modern hearing instruments requires unique solutions to the problem of housing an antenna for the wireless links. The better the antenna, the lower the power consumption of both the transmitter and receiver for a given link performance.

Both the CIC and ITE hearing instruments are custom, as they are fitted and specially built for the wearer of the instrument. For example, a mold may be made of the user's ear or canal for use to build the custom instrument. In contrast, a standard instrument only needs to be programmed for the person wearing the instrument to improve hearing for that person.

SUMMARY

An embodiment of a hearing assistance device comprises an enclosure that includes a faceplate and a shell attached to the faceplate, a power source, a flex antenna, a transmission line connected to the flex antenna, and radio circuit connected to the transmission line and electrically connected to the power source. The flex antenna has a shape of at least a substantially complete loop around the power source, and maintains separation from the power source.

According to an embodiment of a method of forming a hearing assistance device with a power source, a flexible antenna loop is placed into a shell of the device and is enclosed within housing. The flexible antenna loop is enclosed between the shell and a faceplate. The flexible antenna loop substantially encircles the power source and maintains separation from the power source.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

DETAILED DESCRIPTION

Figure 1A:
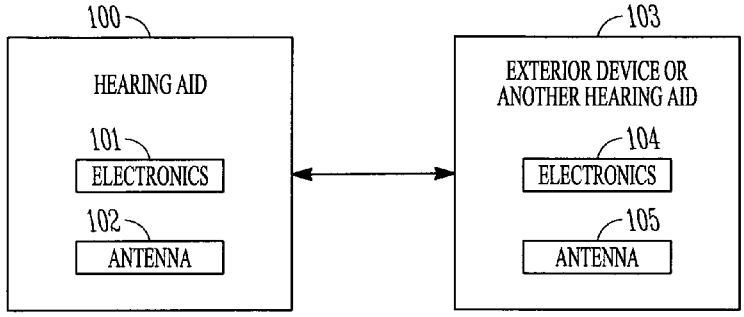
FIGS. 1A and 1B depict embodiments of a hearing instrument having electronics and an antenna for wireless communication with a device exterior to the hearing aid.

The following detailed description of the present subject matter refers to the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

A hearing aid is a hearing device that generally amplifies or processes sound to compensate for poor hearing and is typically worn by a hearing impaired individual. In some instances, the hearing aid is a hearing device that adjusts or modifies a frequency response to better match the frequency dependent hearing characteristics of a hearing impaired individual. Individuals may use hearing aids to receive audio data, such as digital audio data and voice messages wirelessly, which may not be available otherwise for those seriously hearing impaired.

Various embodiments include a single layer or multi-layer flex circuit with conductors that combine a transmission line and loop antenna for the purpose of conducting RF radiation to/from a radio to a radiating element within a custom hearing aid. According to some embodiments, the conductor surrounds the power source (e.g. battery) within a custom hearing instrument such that the axis of the loop is orthogonal to the axis of symmetry of the power source. In some embodiments, the antenna has multiple polarizations by including more than one loop for RF current to flow.

According to various embodiments, a conductor forms a loop and is embedded within or adhered to the faceplate of a custom hearing instrument where the conductor surrounds or substantially surrounds the battery such that the axis of the loop is orthogonal to the axis of symmetry of the battery. In some embodiments, a flex circuit transmission line is connected to the conductor acting as an antenna to conduct RF energy from the radio subsystem to the antenna. The flex circuit transmission line allows for some mobility of the hybrid circuit within a custom hearing instrument. The radio subsystem is mounted directly on the conductor acting as an antenna, in some embodiments. If a trench is formed in the faceplate to receive the antenna, some embodiments control the depth of the trench in the faceplate non-uniformly to control the pattern and directivity of the antenna.

Some hearing instrument embodiments use a single or multi-turn loop antenna that includes a single or multi-layer flex circuit conductor formed in the shape of a loop surrounding the battery and contained within a custom hearing instrument. The flex circuit has the combined function of both the radiating element (loop) and the transmission line for the purpose of conducting RF energy from a radio transmitter/receiver device to the antenna. The flexible transmission line allows the connection to the radio subsystem while allowing the circuit some mobility within the shell of the hearing instrument.

Some embodiments use a single or multi-turn loop antenna that includes a conductive metal formed in such a way as to fit around the battery and embedded within the plastic faceplate that is used in the construction of a custom hearing instrument. A transmission line connects the formed metal antenna to the radio inside the hearing instrument. The antenna may be fully or partially embedded within the plastic faceplate. In this system a flex circuit transmission line connects the metal conductor to the radio subsystem while allowing some mobility of the circuit containing the radio with the shell of the hearing instrument.

Some embodiments use a single or multi-turn loop antenna that includes a conductive metal formed in such a way as to fit around the battery and embedded within the plastic faceplate that is used in the construction of a custom hearing instrument. The radio subsystem is attached directly to the solid conductor that forms the antenna. The antenna may be fully or partially embedded within the plastic faceplate.

Some embodiments use a single or multi-turn loop antenna that use a flexible substrate that allows the antenna to conform to the shape of the shell of the hearing instrument to best maximize the aperture of the antenna.

Figure 1B:
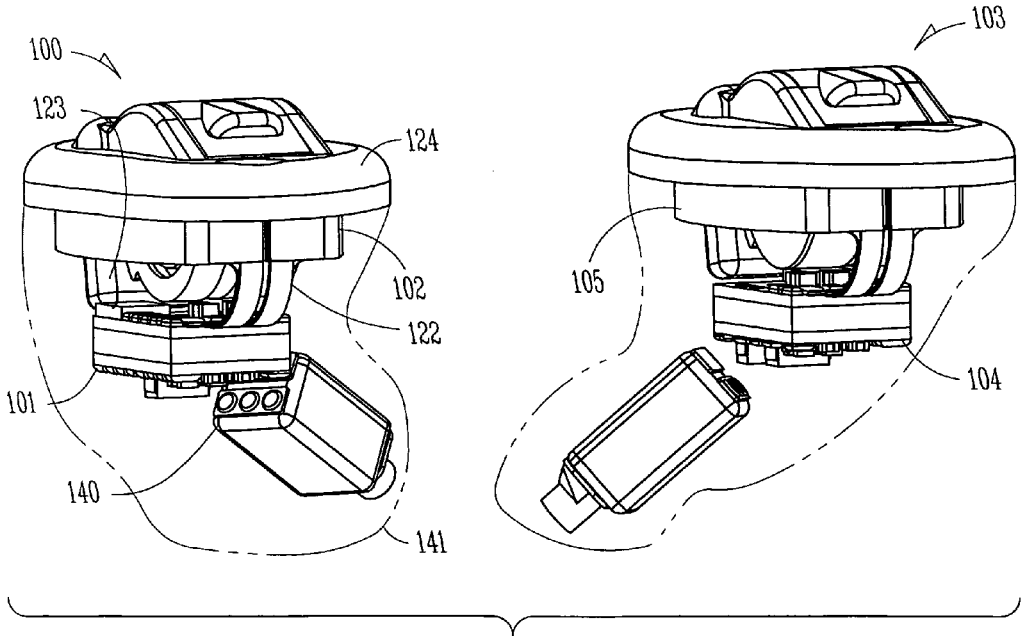

FIGS. 1A and 1B depict embodiments of a hearing instrument having electronics and an antenna for wireless communication with a device exterior to the hearing instrument. FIG. 1A depicts an embodiment of a hearing aid 100 having electronics 101 and an antenna 102 for wireless communication with a device 103 exterior to the hearing aid. The exterior device 103 includes electronics 104 and an antenna 105 for communicating information with hearing aid 100. In an embodiment, the hearing aid 100 includes an antenna having a working distance ranging from about 2 meters to about 3 meters. In an embodiment, the hearing aid 100 includes an antenna having working distance ranging to about 10 meters. In an embodiment, the hearing aid 100 includes an antenna that operates at about −10 dBm of input power. In an embodiment, the hearing aid 100 includes an antenna operating at a carrier frequency ranging from about 400 MHz to about 3000 MHz. In an embodiment, the hearing aid 100 includes an antenna operating at a carrier frequency of about 916 MHz. In an embodiment, the hearing aid 100 includes an antenna operating at a carrier frequency of about 916 MHz with a working distance ranging from about 2 meters to about 3 meters for an input power of about −10 dBm. According to various embodiments, the the carrier frequencies fall within an appropriate unlicensed band (e.g. ISM (Industrial Scientific and Medical) frequency band in the United States). For example, some embodiments operate within 902-928 MHz frequency range for compliance within the United States, and some embodiments operate within the 863-870 MHz frequency range for compliance within the European Union.

FIG. 1B illustrate two hearing aids 100 and 103 with wireless communication capabilities. In addition to the electronics (e.g. hybrid circuit) and antennas, the illustrated hearing aids include a faceplate substrate 124, a battery 122 received in an opening of faceplate substrate through a battery door, a microphone 123, and a receiver 140 within a shell 141 of the hearing aid.

Figure 2A:
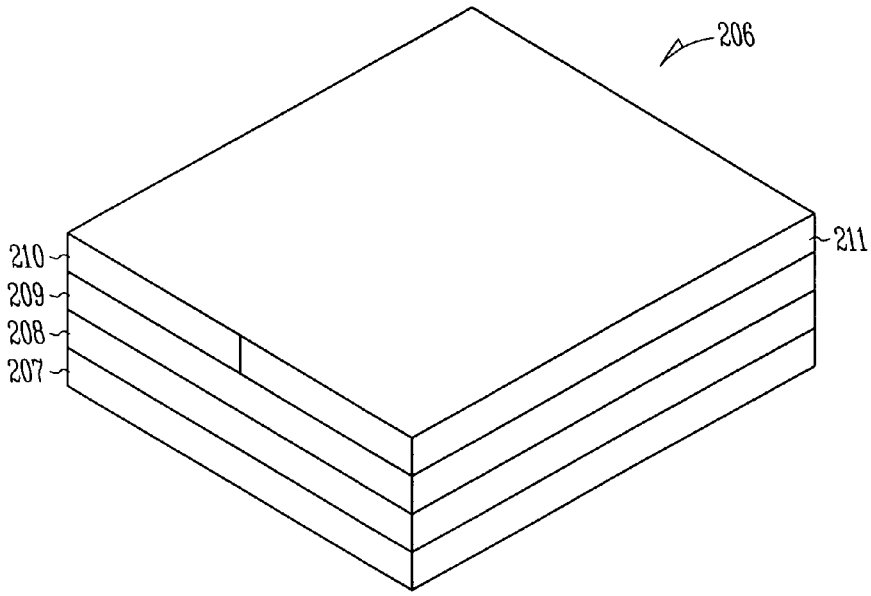
FIGS. 2A and 2B illustrate embodiments of a hybrid circuit, such as may provide the electronics for the hearing instruments of FIGS. 1A-1B.
Figure 2B:
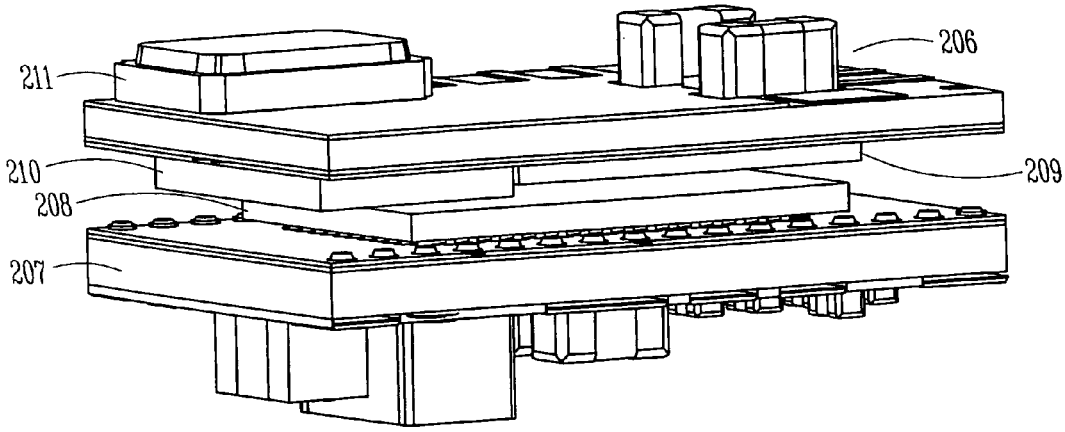

FIG. 2A and 2B illustrate some embodiments of a hybrid circuit, such as may provide the electronics 101 for the hearing instruments 100 of FIG. 1A and 1B. In general, a hybrid circuit is a collection of electronic components and one or more substrates bonded together, where the electronic components include one or more semiconductor circuits. In some cases, the elements of the hybrid circuit are seamlessly bonded together. In various embodiments, the substrate has a dielectric constant less than 3 or a dielectric constant greater than 10. In an embodiment, substrate is a quartz substrate. In an embodiment, the substrate is a ceramic substrate. In an embodiment, the substrate is an alumina substrate. In an embodiment, the substrate has a dielectric constant ranging from about 3 to about 10.

Hybrid circuit 206 includes a foundation substrate 207, a hearing aid processing layer 208, a device layer 209 containing memory devices, and a layer having a radio frequency (RF) chip 210 and a crystal 211. The crystal 211 may be shifted to another location in hybrid circuit and replaced with a surface acoustic wave (SAW) device. The SAW device, such as a SAW filter, may be used to screen or filter out noise in frequencies that are close to the wireless operating frequency.

The hearing aid processing layer 208 and device layer 209 provide the electronics for signal processing, memory storage, and sound amplification for the hearing aid. In an embodiment, the amplifier and other electronics for a hearing may be housed in a hybrid circuit using additional layers or using less layers depending on the design of the hybrid circuit for a given hearing aid application. In an embodiment, electronic devices may be formed in the substrate containing the antenna circuit. The electronic devices may include one or more application specific integrated circuits (ASICs) designed to include a matching circuit to couple to the antenna or antenna circuit.

Figure 3:
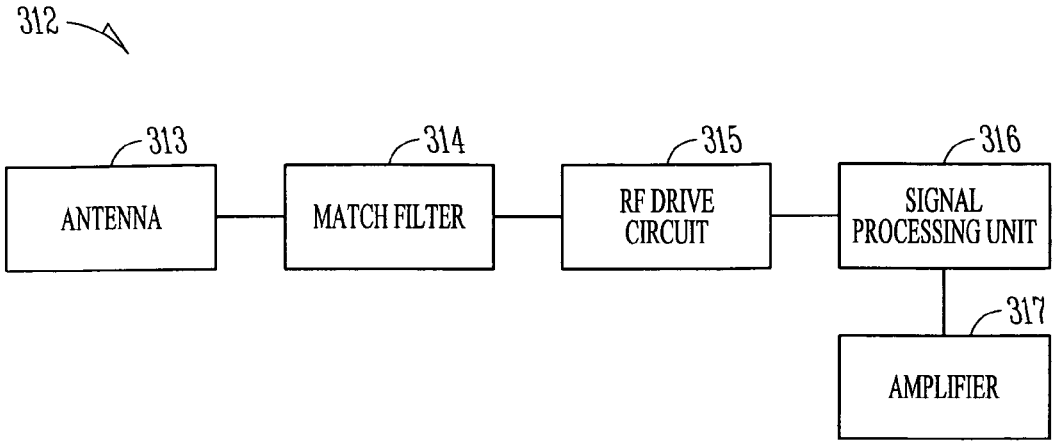
FIG. 3 shows a block diagram of an embodiment of a circuit configured for use with other components in a hearing instrument.

FIG. 3 shows a block diagram of an embodiment of a circuit 312 configured for use with other components in a hearing instrument. The hearing instrument may include a microphone, a power source or other sensors and switches not illustrated in FIG. 3. The illustrated circuit 312 includes an antenna 313, a match filter 314, an RF drive circuit 315, a signal processing unit 316, and an amplifier 317. The match filter 314, RF drive circuit 315, signal processing unit 316, and amplifier 317 can be distributed among the layers of the hybrid circuit illustrated in FIG. 2, for example. The match filter 314 provides for matching the complex impedance of the antenna to the impedance of the RF drive circuit 315. The signal processing unit 316 provides the electronic circuitry for processing received signals via the antenna 313 for wireless communication between the hearing aid and a source external to the hearing aid. The source external to the hearing instrument can be used to transfer information for testing and programming of the hearing instrument. The signal processing unit 316 may also provide the processing of signals representing sounds, whether received as acoustic signals or electromagnetic signals. The signal processing unit 316 provides an output that is increased by the amplifier 317 to a level which allows sounds to be audible to the hearing instrument user. The amplifier 317 may be realized as an integral part of the signal processing unit 316.

As can be appreciated by those skilled in the art upon reading and studying this disclosure, the elements of a hearing instrument housed in a hybrid circuit that includes an integrated antenna can be configured in various formats relative to each other for operation of the hearing instrument.

Figure 4:
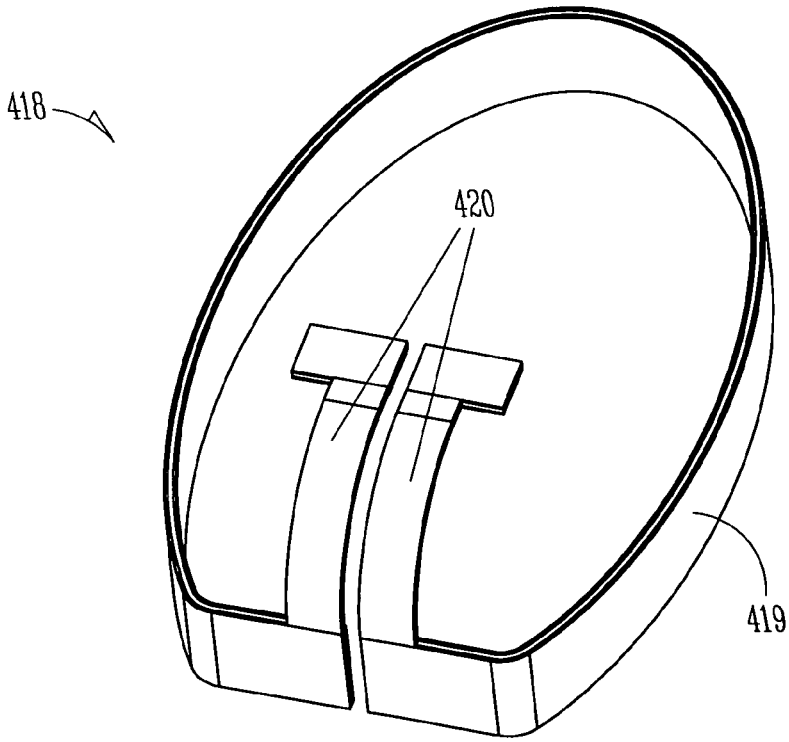
FIG. 4 illustrates a flex circuit antenna, also referred to as a flex antenna, according to various embodiments.

FIG. 4 illustrates a flex circuit antenna, also referred to as a flex antenna, according to various embodiments. The illustrated flex circuit antenna 418 is illustrated with a looped-shaped antenna portion 419 and integrated flexible transmission lines 420. The flat design of the antenna portion 419 promotes a desired current density by providing the flat surface of the antenna portion 419 parallel with an axis of the loop.

A design goal to increase quality for an antenna is to increase the aperture size of the antenna loop, and another design goal is to decrease the loss of the antenna. Magnetic material (e.g. iron) and electrical conductors within the loop increase loss. Separation between the magnetic material and the antenna decreases the amount of the loss. Various embodiments maintain separation between the antenna and the battery and electrical conductors to reduce the amount of loss.

A flex antenna uses a flex circuit, which is a type of circuitry that is bendable. The bendable characteristic is provided by forming the circuit as thin conductive traces on a thin flexible medium such as a polymeric material or other flexible dielectric material. The flex antenna includes flexible conductive traces on a flexible dielectric layer. In an embodiment, the flex antenna is disposed on substrate on a single plane or layer. In an embodiment, the antenna is configured as a flex circuit having thin metallic traces on a polyimide substrate. Such a flex design may be realized with an antenna layer or antenna layers of the order of about 0.003 inch thick. A flex design may be realized with a thickness of about 0.006 inches. Such a flex design may be realized with antenna layers of the order of about 0.004 inch thick. A flex design may be realized with a thickness of about 0.007 inches as one or multiple layers.

The dielectric layer of a flex antenna is a flexible dielectric material that provides insulation for the conductive layer. In an embodiment, the dielectric layer is a polyimide material. In an embodiment for a flex antenna, a thin conductive layer is formed in or on a thin dielectric layer, where the dielectric layer has a width slightly larger than the width of conductive layer for configuration as an antenna. An embodiment uses copper for the metal, and some embodiments plate the copper with silver or nickel or gold. Some embodiments provide a copper layer on each side of a coverlay (e.g. polyimide, liquid crystal polymer, or Teflon material). The thickness of a flex circuit will typically be smaller than a hard metal circuit, which allows for smaller designs. Additionally, the flexible nature of the flex circuit makes the fabrication of the device easier.

Figure 5:
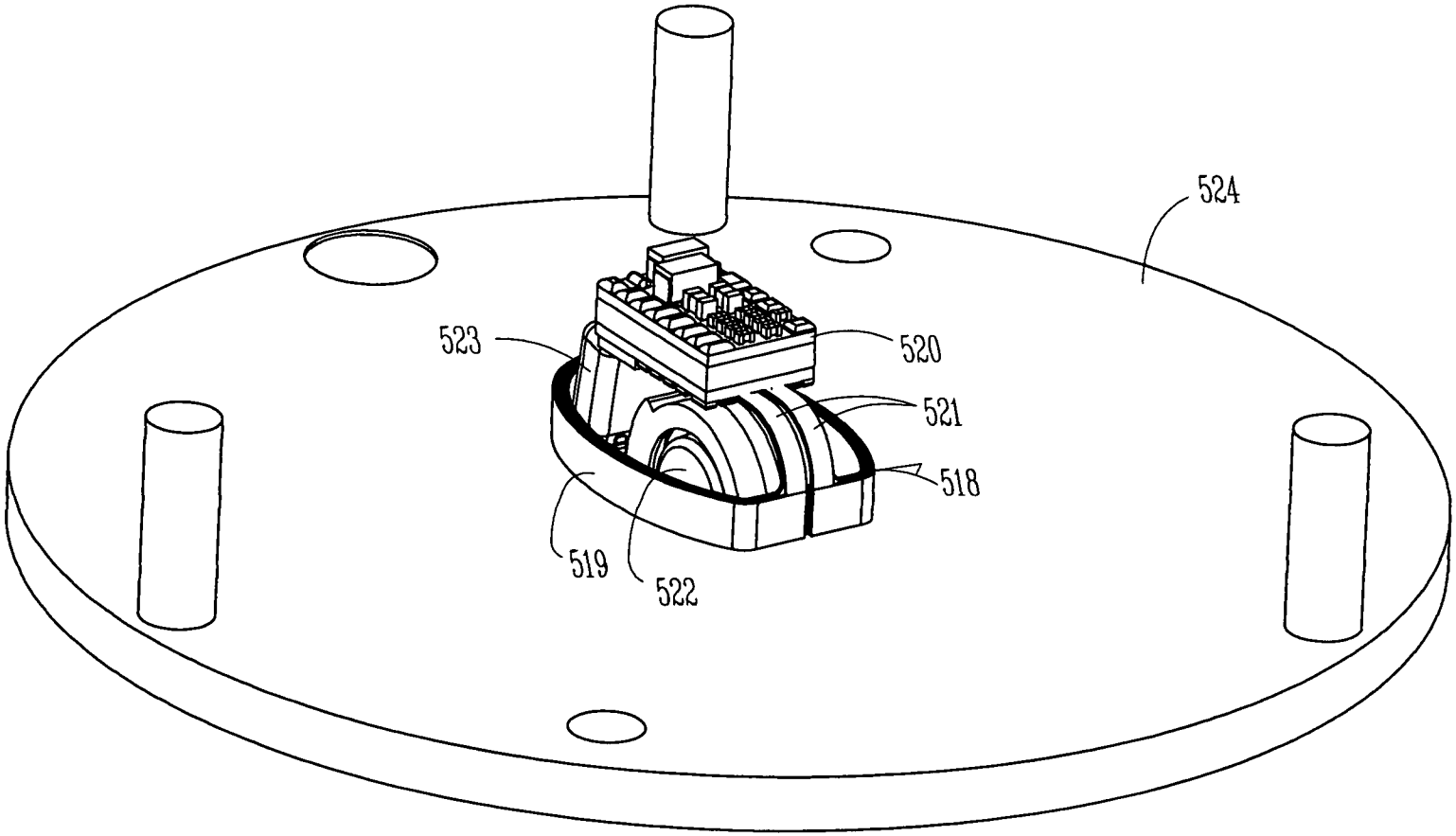
FIG. 5 illustrates an embodiment of a flex antenna with attached hybrid radio.

FIG. 5 illustrates an embodiment of a flex antenna 518, such as illustrated at 418 in FIG. 4, with attached hybrid radio 521. The figure illustrates a battery 522 within a battery door, a microphone 523 and the hybrid radio 520. According to various embodiments, the hybrid radio includes a radio, an EPROM, and a processor/digital signal processor (DSP). The assembly is illustrated on a faceplate 524. The faceplate functions as a working surface or substrate, on which the illustrated device is assembled. A shell of the hearing aid is glued onto the faceplate to encase the antenna and hybrid radio. In the illustrated figure, the shell is glued on the top side of the faceplate, and the battery door opens down from the face plate. After the shell is glued onto the faceplate, excess portions of the faceplate are cut and ground away. The loop-shaped antenna portion 519 is fixed (e.g. glued) onto the faceplate. An embodiment allows the flex antenna loop to freely conform to the shape of the shell. An embodiment places this portion of the antenna within a groove formed within the faceplate. The illustrated hybrid radio 520 is connected to the transmission line 521, and will float over the battery and microphone within the shell of the hearing aid.

Figure 6:
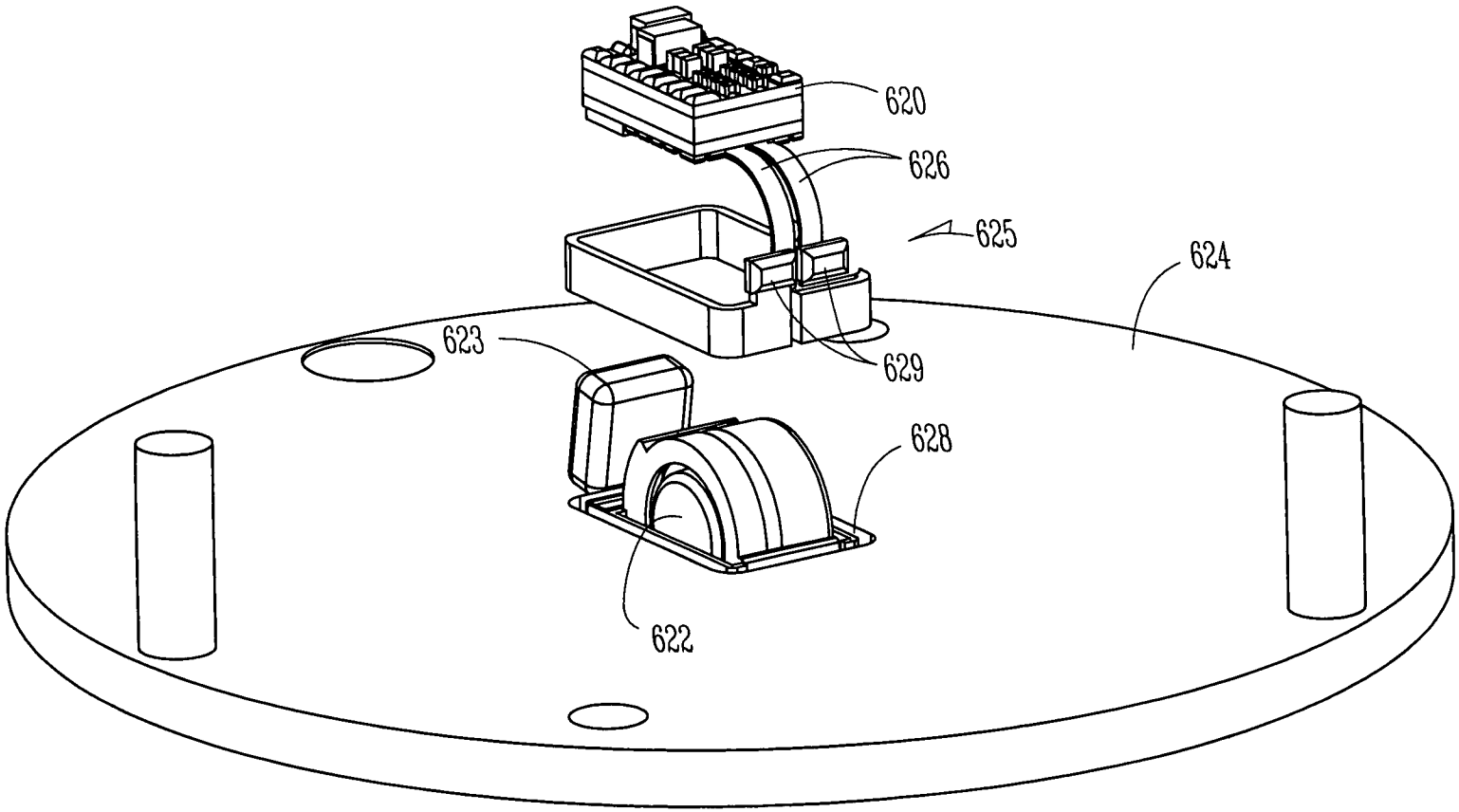
FIG. 6 illustrates an embodiment with a solid conductor prior to insertion on the faceplate.

FIG. 6 illustrates an embodiment with a solid conductor prior to insertion on the faceplate. The illustrated figure shows a faceplate 624, a battery 622 within a battery door, a microphone 623, a hybrid radio 620, and an antenna 625. In the illustrated embodiment, the transmission line 626 is a flex circuit, and the loop-shaped portion 627 of the antenna is a hard metal. According to an embodiment, the loop-shaped portion 627 is brass. According to an embodiment, the loop-shaped portion 627 is silver. According to an embodiment, the loop-shaped portion is copper. The illustrated faceplate 624 has a groove 628 formed around the battery door to receive the loop-shaped portion 627 of the antenna, and formed with a depth such that the top of the loop-shaped portion is approximately flush with the top of the faceplate. In the illustrated embodiment, solder joints 629 provide a mechanical and electrical connection between the hard metal and the flex circuit. As in the embodiment illustrated in FIG. 5, the hybrid radio will float over the microphone and battery within the shell that is glued onto the faceplate and over the hybrid radio.

Figure 7:
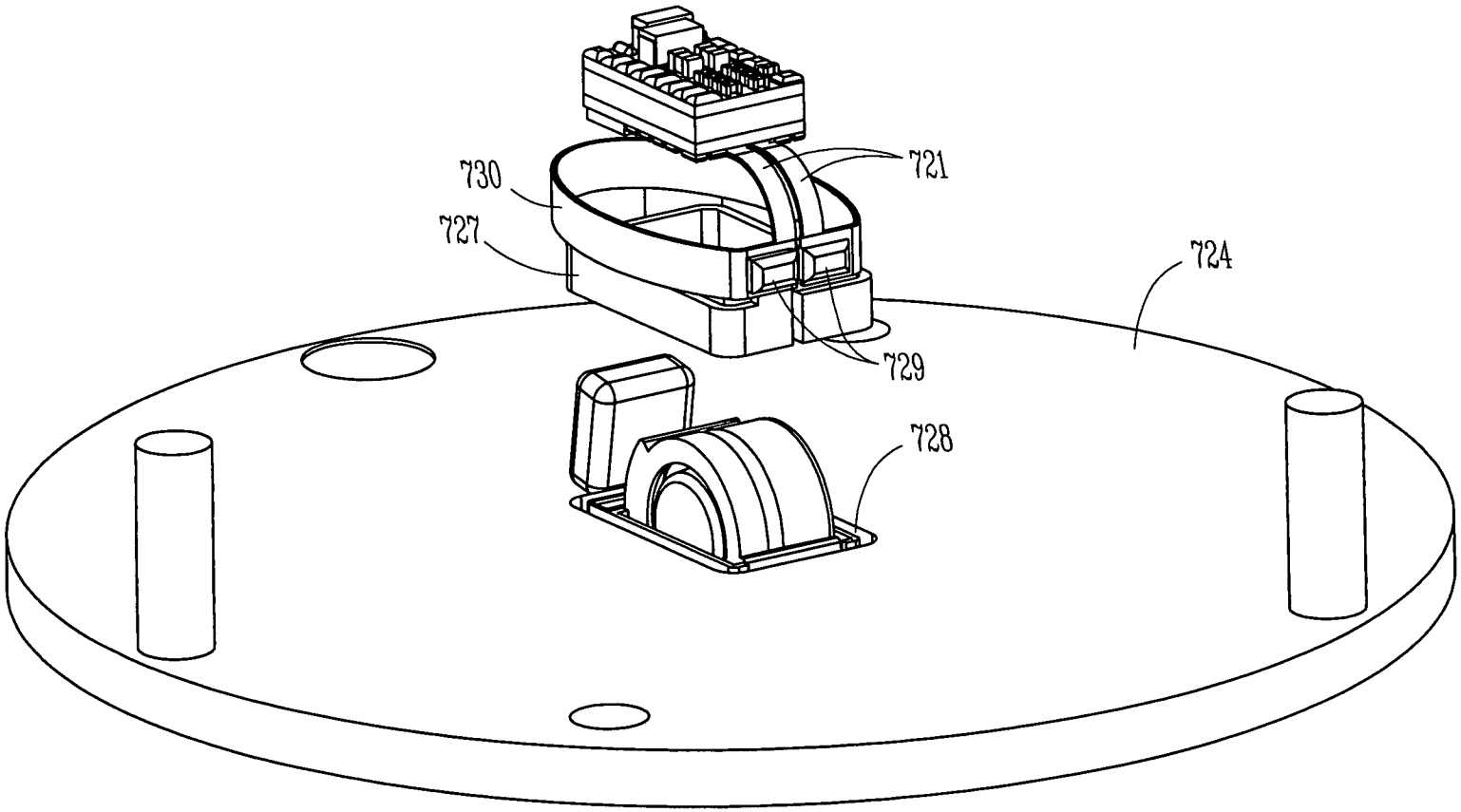
FIG. 7 illustrates a combination flex antenna with solid conductor prior to insertion into faceplate, according to an embodiment.

FIG. 7 illustrates a combination flex antenna with solid conductor prior to insertion into faceplate, according to an embodiment. This figure is similar to FIG. 6. However, in the embodiment illustrated in FIG. 7, the antenna includes a second loop, which functions to change the current distribution to drop inductance and change the resonance. In the illustrated embodiment, the second loop 730 is a flex circuit. In some embodiments, the transmission lines 721 and the second loop 730 are integrated into a flex circuit. Solder joins 729 provide a mechanical and electrical connection between the first, hard metal loop 727 and the flex circuit for the second loop 730/transmission lines 721. The illustrated faceplate 724 has a groove 728 formed around the battery door to receive the first, hard metal loop 727, and formed with a depth such that the top of the first loop is approximately flush with the top of the faceplate.

Figure 8:
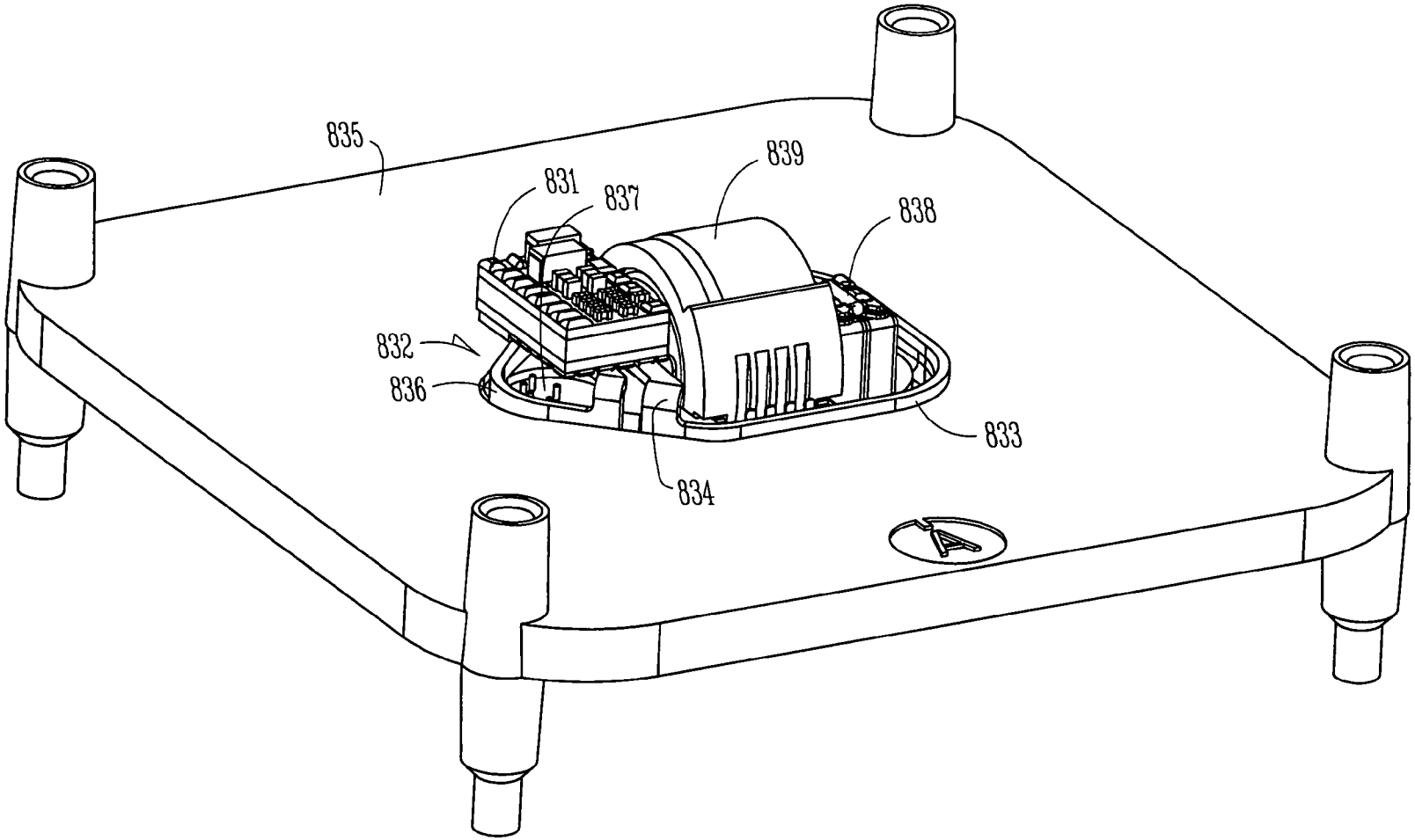
FIG. 8 illustrates a hybrid circuit including a radio mounted directly on an antenna, according to an embodiment.

FIG. 8 illustrates a hybrid circuit including a radio 831 mounted directly on an antenna 832, according to an embodiment. The illustrated antenna 832 is a shim antenna formed from a hard metal such as brass. The antenna 832 includes a loop-shaped portion 833 integrally formed with transmission lines 834. The faceplate 835 has a groove 836 sized and shaped to receive the loop-shaped portion 833 of the antenna 832. The illustrated loop-shaped portion 833 loops around a volume control 837, a microphone 838, and a battery 839 within a battery door. In the illustrated embodiment, the radio hybrid circuit 831 is mounted on the transmission line 834 over the volume control. In other embodiments, the radio hybrid circuit 831 is mounted over other components, such as, for example, the microphone.

Figure 9:
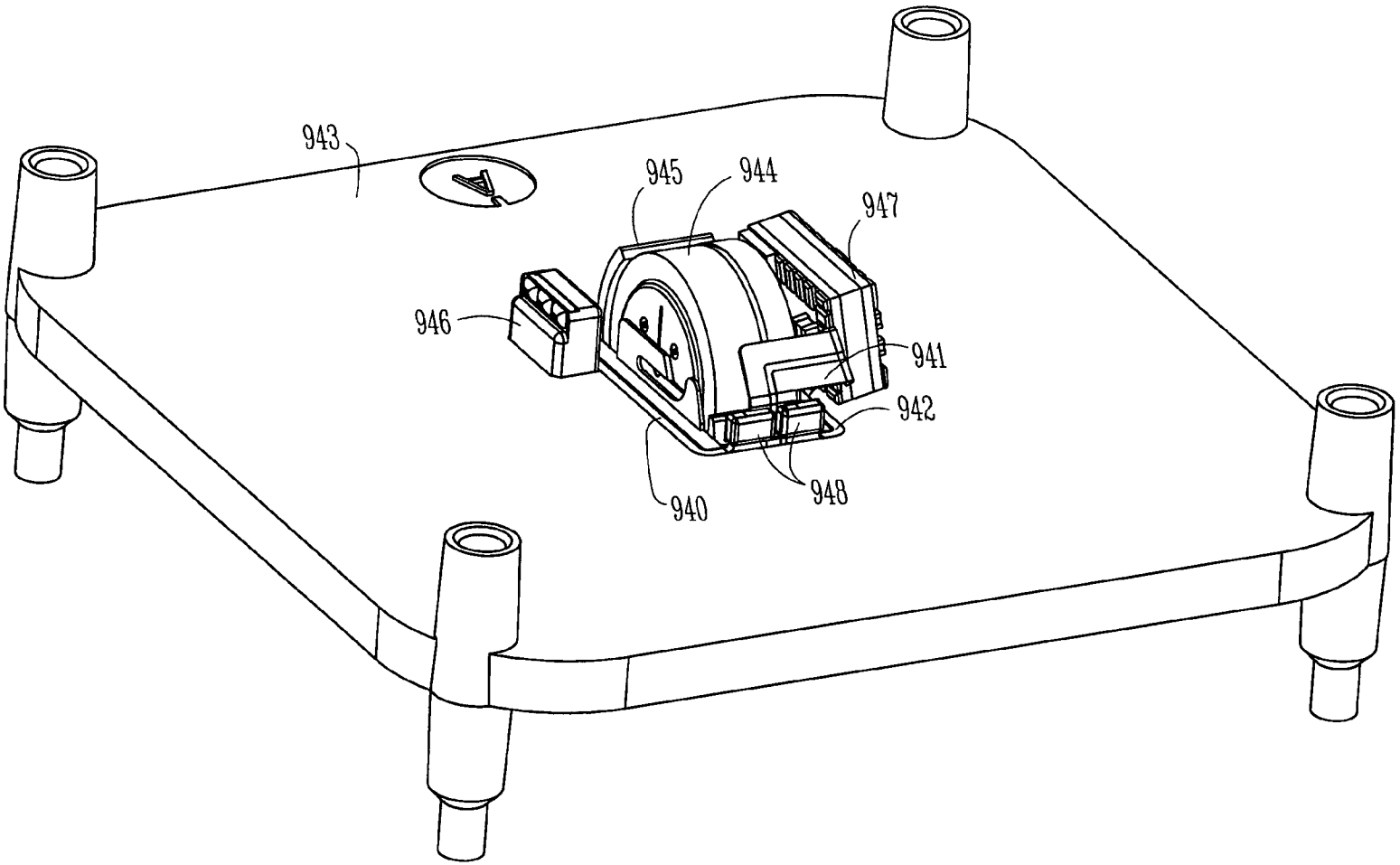
FIG. 9 illustrates an embodiment including a shim antenna and a flex circuit transmission line.

FIG. 9 illustrates an embodiment including a shim antenna 940 and a flex circuit transmission line 941. The shim antenna 940 is formed from a hard metal, such as brass, and is illustrated within a groove 942 formed within the faceplate 943 The shim antenna 940 is illustrated as forming a loop around the battery 944 within a battery door 945. In the illustrated embodiment, a microphone 946 is not within the loop formed by the shim antenna. The radio hybrid circuit 947 is attached to the flex circuit transmission lines 941, and floats along the side of a battery. The transmission lines 941 are attached to the shim antenna 940 using solder joints 948.

Figure 10A:
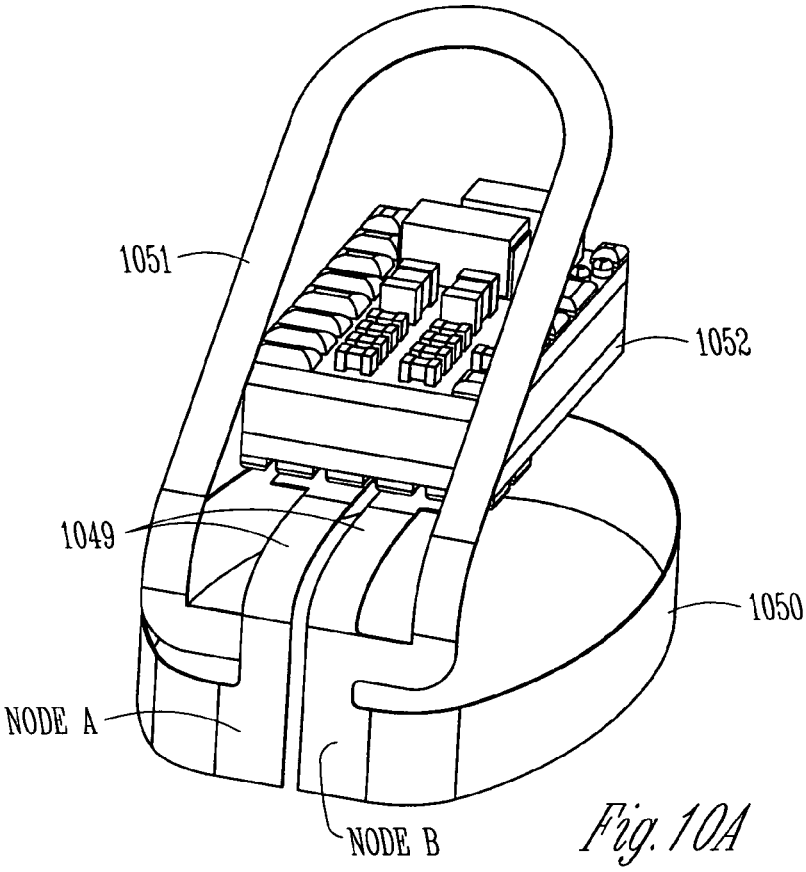
FIGS. 10A-C illustrate a dual polarized antenna, according to various embodiments.
Figure 10B:
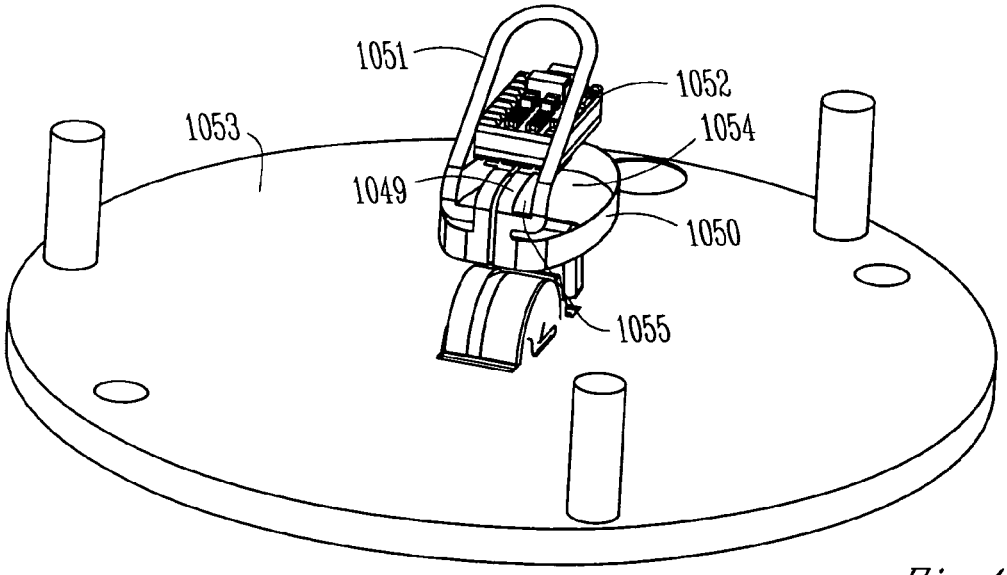
Figure 10C:
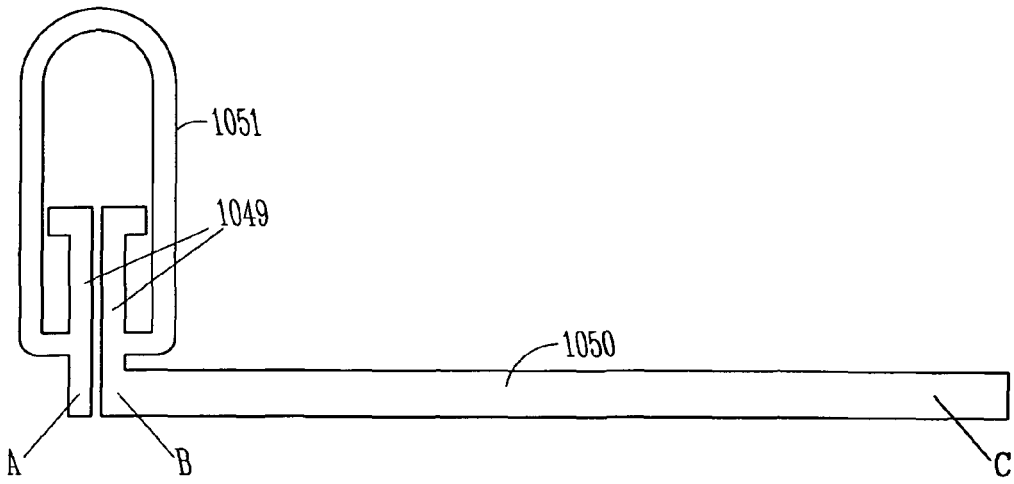

FIGS. 10A-C illustrate a dual polarized antenna, according to various embodiments. A hearing instrument embodiment that incorporates a dual polarized antenna incorporates two parallel loop antennas of various polarizations as well as a transmission line to connect the radio subsystem with the radiating elements of the antenna. FIG. 10A illustrates a flex circuit that includes transmission lines 1049, a first loop 1050 of the antenna and a second loop 1051 of the antenna. The second loop has a different orientation than the first. These loops are electrically parallel, as these two loops form two current paths from node "A" to node "B". The transmission lines 1049 connect the radio hybrid circuit 1052 to the first and second loops 1050 and 1051 of the antenna. FIG. 10B illustrates the flex circuit and radio hybrid circuit illustrated in FIG. 10A positioned in grooves in the faceplate 1053, and positioned around a battery 1054 and a microphone 1055. FIG. 10C illustrates a flat flex circuit used to form the dual polarized antenna. The illustrated circuit can be stamped out of a sheet of flex circuit material. The first loop 1050 is formed by attaching the end marked "C" to node "A" on the transmission line.

Figure 11:
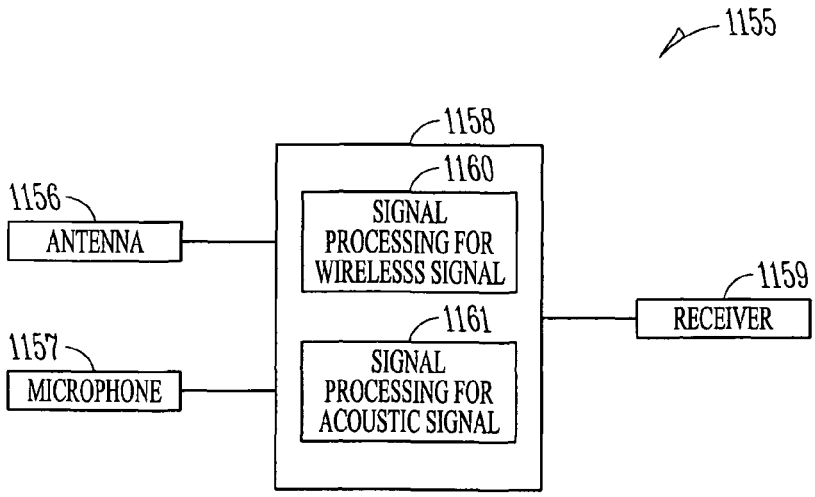
FIG. 11 illustrates a block diagram for a hearing assistance device, according to various embodiments.

FIG. 11 illustrates a block diagram for a hearing assistance device, according to various embodiments. An example of a hearing assistance device is a hearing aid. The illustrated device 1155 includes an antenna 1156 according to various embodiments described herein, a microphone 1157, signal processing electronics 1158, and a receiver 1159. The illustrated signal processing electronics includes signal processing electronics 1160 to process the wireless signal received or transmitted using the antenna. The illustrated signal processing electronics 1158 further include signal processing electronics 1161 to process the acoustic signal received by the microphone. The signal processing electronics 1158 is adapted to present a signal representative of a sound to the receiver (e.g. speaker), which converts the signal into sound for the wearer of the device 1155.

Figure 12A:
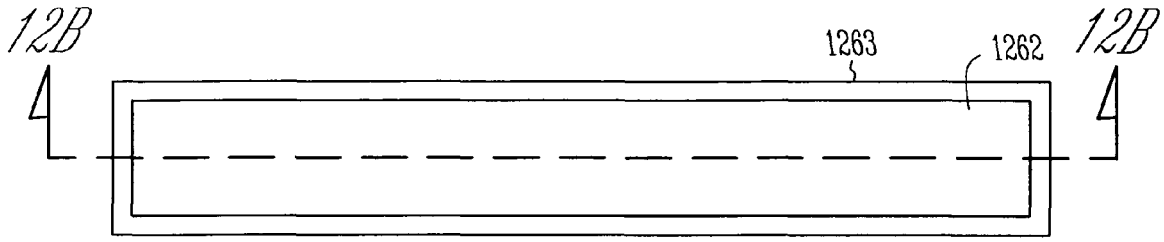
FIGS. 12A-12B illustrate an embodiment of flex circuit material with a single trace, such as may be used to form flex circuit antennas.
Figure 12B:
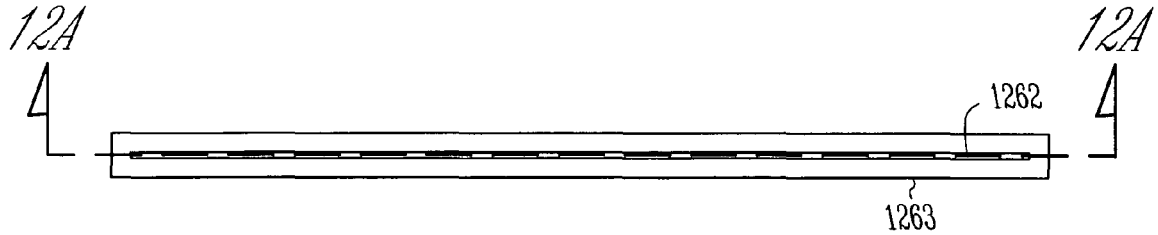

FIGS. 12A-12B illustrate an embodiment of flex circuit material with a single trace, such as may be used to form flex circuit antennas. In the illustrated embodiment, a thin conductor 1262 is sandwiched between flexible dielectric material 1263, such as a polyimide material. An embodiment uses copper for the thin conductor. Some embodiments plate the copper with silver or nickel or gold. The size and flexible nature of the flex circuit makes the fabrication of the device easier. Some flex circuit embodiments are designed with the appropriate materials and thicknesses to provide the flex circuit with a shape memory, as the flex circuit can be flexed but tends to return to its original shape. Some flex embodiments are designed with the appropriate materials and thicknesses to provide the flex circuit with shape resilience, as the flex circuit can be flexed into a shape and will tend to remain in that shape. Some embodiments integrate circuitry (e.g. match filter, RF drive circuit, signal processing unit, and/or amplifier) into the flex circuit.

Figure 13A:
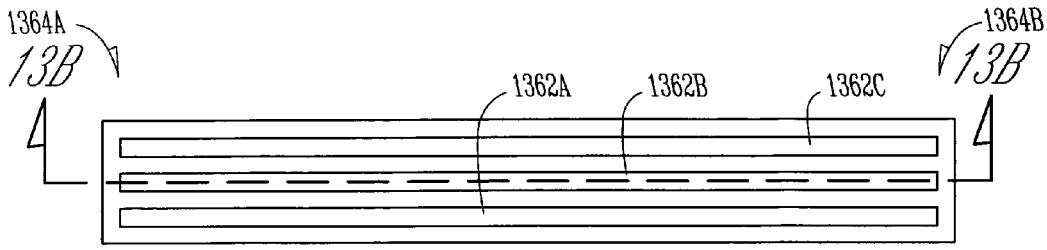
FIGS. 13A-13C illustrate an embodiment of flex circuit material with multiple traces, such as may be used to form flex circuit antennas.
Figure 13B:
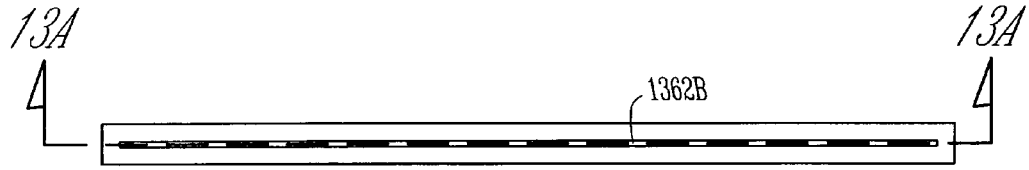
Figure 13C:
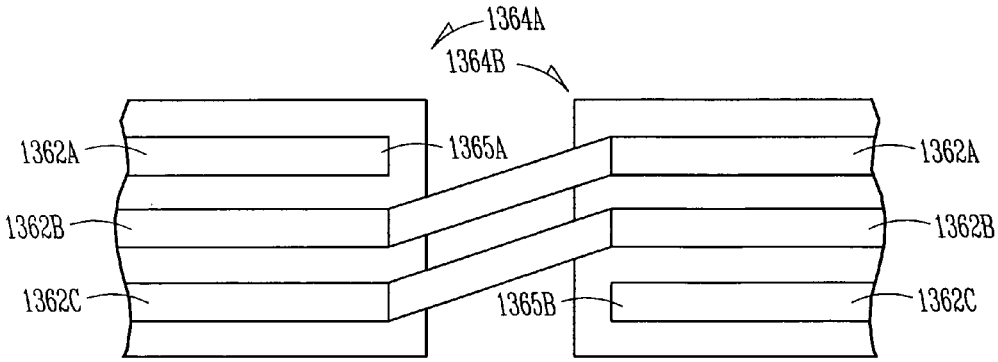

FIGS. 13A-13B illustrate an embodiment of flex circuit material with multiple traces, such as may be used to form flex circuit antennas. In the illustrated embodiment, multiple thin conductors 1362A, 1362B and 1362C are sandwiched between flexible dielectric material 1363, such as a polyimide material. When forming a loop or a substantial loop using the flex circuit, the first end 1364A and the second end 1364B are proximate to each other. The ends of the individual traces 1632A-C can be soldered or otherwise connected together to form multiple loops of conductor within a single loop of a flex circuit. Contacts to transmission lines can be taken at 1365A and 1365B, or the flex circuit can be formed to provide integral transmission lines extending from 1365A and 1365B.

Figure 14A:
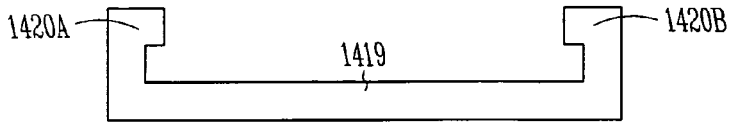
FIGS. 14A-C illustrate an embodiment of a flex circuit for a single loop antenna.
Figure 14B:
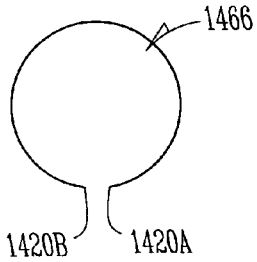
Figure 14C:
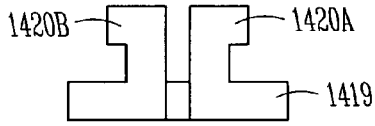

FIGS. 14A-C illustrate an embodiment of a flex circuit for a single loop antenna. The illustrated embodiment includes an antenna portion 1419 and integrated flexible transmission lines 1420A-B. The antenna can be flexed to form a single loop 1466, as illustrated in FIGS. 14A-B.

Figure 15A:
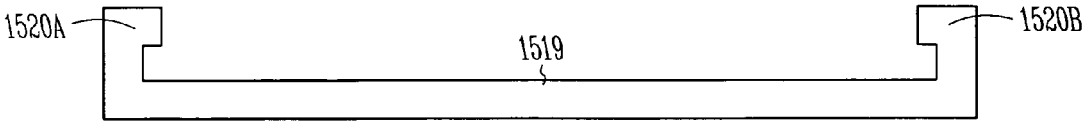
FIGS. 15A-C illustrate an embodiment of a flex circuit for a multi-turn antenna.
Figure 15B:
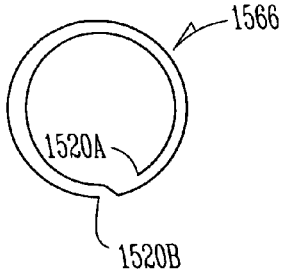
Figure 15C:
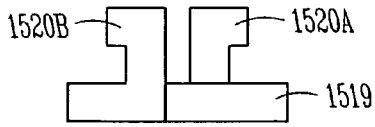

FIGS. 15A-C illustrate an embodiment of a flex circuit for a multi-turn antenna. The illustrated embodiment includes an antenna portion 1519 and integrated flexible transmission lines 1520A-B. The length of the antenna portion is such that the antenna can be flexed to form two or more turns 1566, as illustrated in the top view of FIG. B and the side view of FIG. C. Current flows serially through the turns. Some embodiments coil the turns in the same plane, as illustrated in FIG. 15C, and some embodiments form a helix with the coils. The serially-connected turns improve the receive signal from the antenna.

Figure 16A:
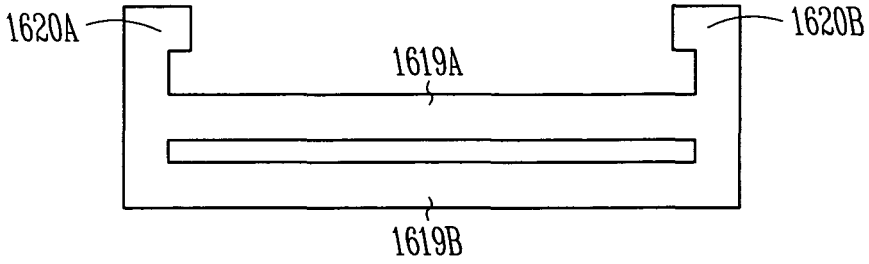
FIGS. 16A-C illustrate an embodiment of a flex circuit for a multi-loop antenna.
Figure 16B:
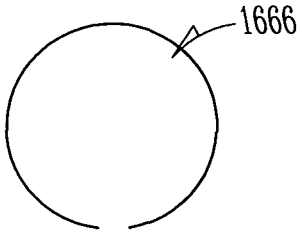
Figure 16C:
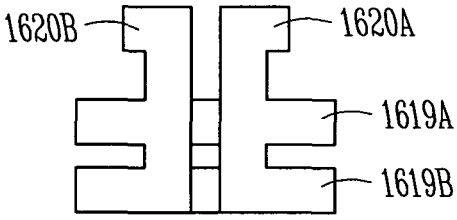

FIGS. 16A-C illustrate an embodiment of a flex circuit for a multi-loop antenna. The illustrated embodiment includes antenna portions 1619A and 1619B connected in parallel between integrated flexible transmission lines 1620A-B. Each antenna portion forms a loop or substantially forms a loop, as illustrated in the top view of FIG. 16B and the side view of FIG. 16C. The parallel antenna portions reduce antenna loss in comparison to a single antenna portion.

Figure 17A:
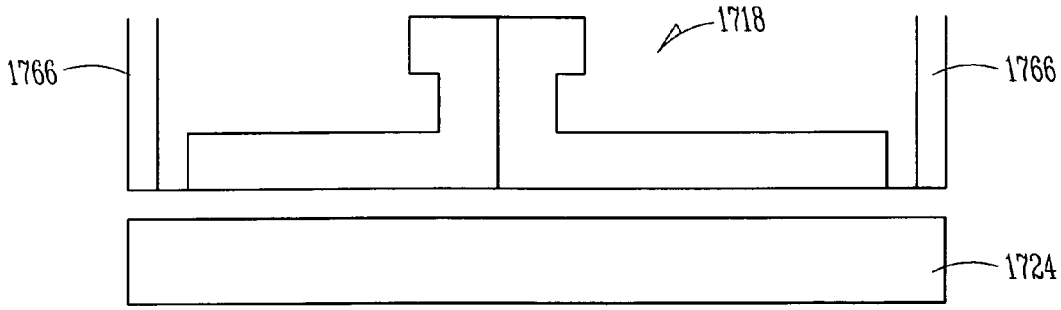
FIGS. 17A-17B illustrate a side view of a faceplate and a cross-section of a shell to be adhered to the faceplate, with a flex antenna in the shell, according to an embodiment.
Figure 17B:
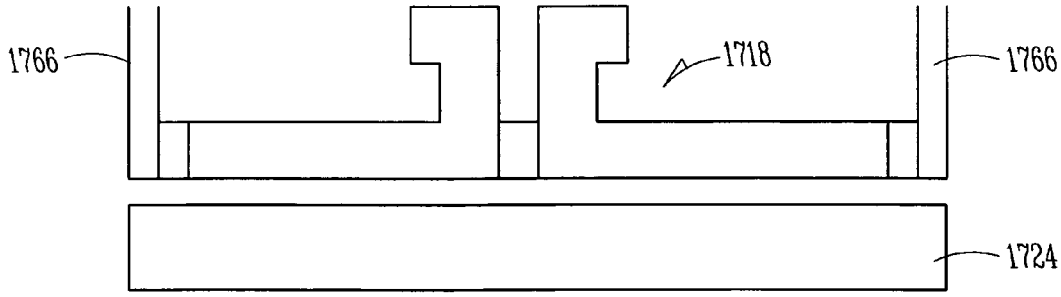

FIGS. 17A-17B illustrate a side view of a faceplate 1724 and a cross-section of a shell 1766 to be adhered to the faceplate, with a flex antenna in the shell, according to an embodiment. When placed in the shape of a loop, the flex circuit tends to straightened. Various embodiments of the present subject matter use this tendency of the flex circuit to straighten to bias the antenna against a portion of the interior surface of the shell. For example, some flex circuit antenna embodiments substantially conform to an interior surface of the shell. Some flex circuit embodiments contact the interior surface of the shell for a substantial portion of the circumference of the shell. FIG. 17A illustrates the antenna in a compressed loop for installation within the shell, and FIG. 17B illustrates the antenna biased against an interior surface of the shell. FIGS. 17A-17B are simple illustrations of a compressed loop and a more relaxed loop. By way of example, transmission lines are connected to circuitry before the antenna is inserted into the shell, which affects how the flex antenna will compress. The flex antenna is held in position by the bias force against the shell. In some embodiments, the radio circuit is supported by the transmission lines that are integrally formed with the flex antenna.

Figure 18A:
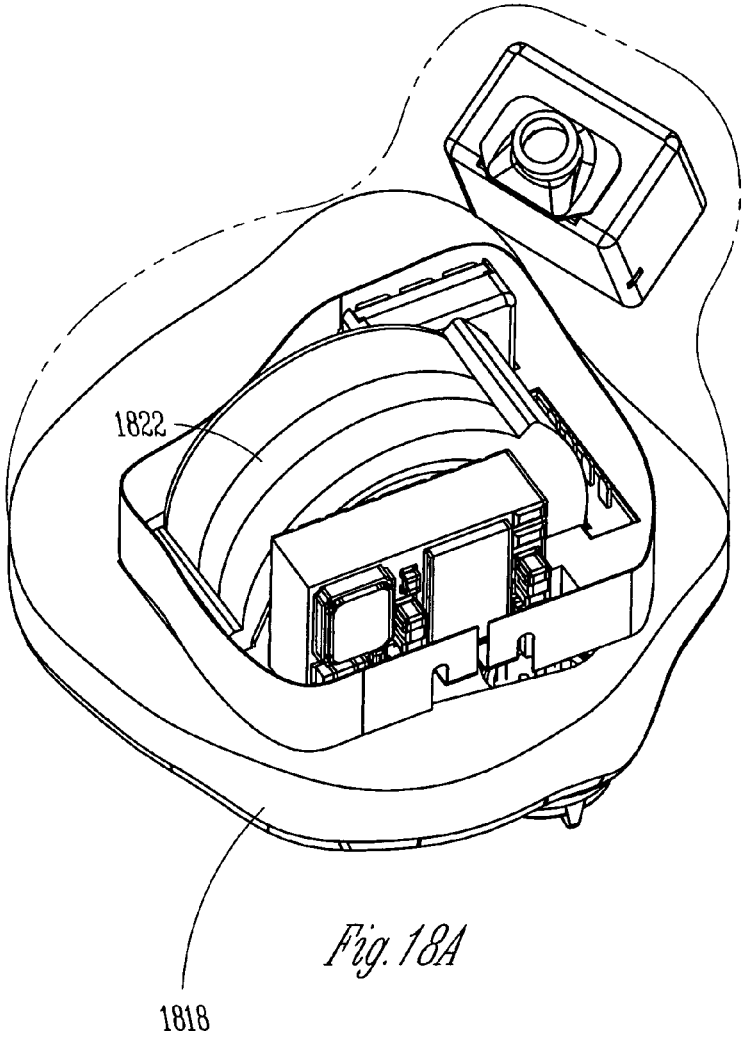
FIG. 18A-B illustrate an embodiment where the flex antenna forms a loop around multiple components of the hearing instrument.
Figure 18B:
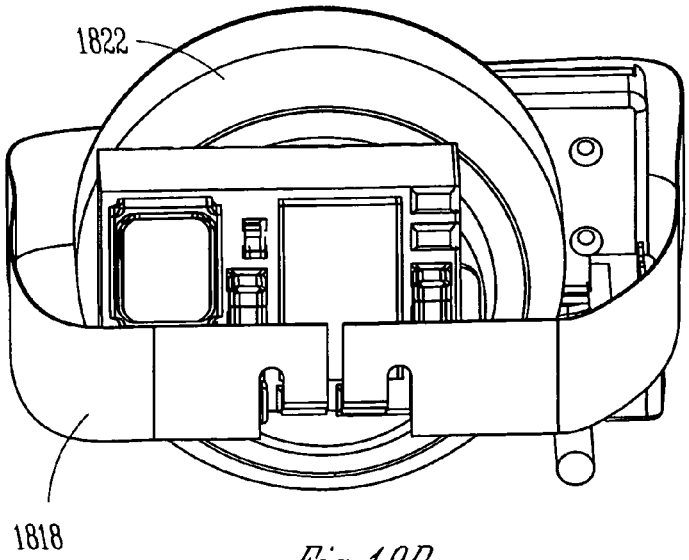

FIG. 18A-B illustrate an embodiment where the flex antenna forms a loop around multiple components of the hearing instrument. In this embodiment, the antenna 1818 maintains separation from the power source 1822 (e.g. battery). The antenna is not wrapped tightly around the power source or otherwise in contact with the power source. The separation of the flex circuitry from the battery increases the aperture size of the antenna loop, and also reduces loss attributed to the battery. Some embodiments wrap the flex circuit around some of these other components in the hearing instrument. In some embodiments, the flex circuit is formed to have a shape-resilient quality, such that it can be formed into a desired shape and will maintain the shape. In this embodiment, the flex circuit is formed into a desired shape to surround multiple components of the hearing instrument, and the transmission lines are connected to the radio circuit. The desired shape can be a shape that provides separation from the battery and some of the other components in the hearing instrument, and that provides a large aperture size for the flex antenna.

In various embodiments, the antenna design is modified to provide different geometries and electrical characteristics. For example, wider antennas or multiple loops electrically connected in parallel provide lower inductance and resistance than thinner or single antenna variations. In some embodiments the antennas include multiple loops electrically connected in series.

In some embodiments, the antenna is made using multifilar wire instead of a flex circuit to provide conductors electrically connected in series or parallel.

The above detailed description is intended to be illustrative, and not restrictive. The scope of the invention should, therefore, be determined with reference to the appended claims, along with the full scope of equivalents to which such claims are legally entitled.

What is claimed is:

1. A hearing assistance device, comprising:

an enclosure that includes a faceplate and a shell attached to the faceplate;

a power source;

a flex antenna having a shape of at least a substantially complete loop around the power source, wherein the flex antenna maintains separation from the power source;

a transmission line connected to the flex antenna; and radio circuit connected to the transmission line and electrically connected to the power source, wherein the transmission line is configured to float the radio circuit over the power source.

2. The device of claim 1, wherein the transmission line is configured to float the radio circuit besides the power source.

3. A hearing assistance device, comprising:

an enclosure that includes a faceplate and a shell attached to the faceplate;

a power source;

a flex antenna having a shape of at least a substantially complete loop around the power source, wherein the flex antenna maintains separation from the power source;

a transmission line connected to the flex antenna;

radio circuit connected to the transmission line and electrically connected to the power source, and wherein the faceplate includes a groove, and the flex antenna is at least partially received within the groove of the faceplate.

4. A method of forming a hearing assistance device with a power source, comprising:

placing a flexible antenna loop into a shell of the device; and enclosing the flexible antenna loop within housing, including:

enclosing the flexible antenna loop between the shell and a faceplate;

substantially encircling the power source with the flexible antenna loop; and maintaining separation between the flexible antenna loop and the power source, wherein placing the flexible antenna loop into the shell of the device includes placing a flex antenna loop into the shell of the device, and wherein the flex antenna loop includes a flex circuit, and wherein the faceplate includes a groove, and wherein placing the flexible antenna loop into the shell of the device includes placing the flexible antenna loop into the groove of the faceplate to be at least partially received in the groove the faceplate, and enclosing the flexible antenna loop between the shell and a faceplate.

5. The device of claim 1, wherein the shell has an interior surface, and a portion of the flex antenna substantially conforms to a portion of the interior surface of the shell.

6. The device of claim 1, wherein the shell has an interior surface, the interior surface has a circumference around the power source, and the flex antenna substantially conforms to the interior surface of the shell around the circumference.

7. The device of claim 6, wherein the flex antenna has a shape memory that tends to straighten the flex antenna from a flexed position, and bias at least a portion of the flex antenna into contact with the interior surface of the shell.

8. The device of claim 1, wherein the flex antenna is shape resilient to maintain a desired shape around the power source.

9. The device of claim 1, wherein the shape of the flex antenna substantially completes a loop around the power source and additional electrical components of the hearing instrument.

10. The device of claim 1 wherein a flex circuit is configured to provide the antenna and the transmission line integrated with the antenna.

11. The device of claim 1, wherein the flex antenna has a shape of at least a substantially complete first loop and a substantially complete second loop around the power source, and the transmission line is connected to both the first loop and the second loop.

12. The device of claim 11, wherein the first loop and the second loop provide different polarities.

13. The device of claim 3, wherein the transmission line is configured to float the radio circuit over the power source.

14. The device of claim 13, wherein the transmission line is configured to float the radio circuit besides the power source.

15. The device of claim 1, wherein the radio circuit includes a hybrid radio circuit.

16. The device of claim 15, wherein the hybrid radio circuit includes a radio, an EPROM and a digital signal processor.

17. The device of claim 1, wherein the flex antenna includes at least one loop of a flex circuit, the flex circuit has a flat profile, and a flat side of the flex antenna is substantially parallel to an axis of the at least one loop.

18. The device of claim 3, wherein the flex antenna includes a flex circuit, the flex circuit including a conductive layer sandwiched between dielectric layers.

19. The device of claim 1, wherein the faceplate includes a groove, and the flex antenna is at least partially received within the groove of the faceplate.

20. The device of claim 3, wherein the flex antenna is about 0.003 inches thick.

21. The device of claim 3, wherein the shape of the flex antenna includes a first loop at least substantially completely around the power source and a second loop at least substantially completely around the power source, and the first and second loops are electrically connected in parallel.

22. The device of claim 3, wherein the shape of the flex antenna includes a first loop at least substantially completely around the power source and a second loop at least substantially completely around the power source, and the first and second loops are electrically connected in parallel.

23. The device of claim 3 ,wherein the shape of the flex antenna includes a first loop at least substantially completely around the power source and a second loop at least substantially completely around the power source, and the first and second loops are electrically connected in series.

24. The method of claim 4, further comprising integrally forming the flex antenna loop with a flex circuit transmission line, and connecting the flex circuit transmission line to a radio circuit.

25. The method of claim 4, further comprising forming a flex circuit, including sandwiching a layer of dielectric material between two layers of conductive material, wherein the flex circuit transmission line is formed using the flex circuit.

26. The method of claim 4, further comprising stamping out a template from the flex circuit, the template including a first portion used to form the transmission line, a second portion used to form the antenna loop, and a third portion used to form a second antenna loop.

27. The method of claim 4, further comprising forming the flex antennal loop into a desired shape to substantially loop around and maintain distance from the power source before placing the loop into the shell of the device.

28. The method of claim 4, further comprising:

compressing the flex antenna loop;

placing the compressed flex antenna loop into the shell of the device: and relaxing the flex antenna loop to bias a substantial portion of the loop into contact with an interior surface of the shell.

* * * * *

UNITED STATES PATENT AND TRADEMARK OFFICE

CERTIFICATE OF CORRECTION

PATENT NO. : 8,494,197 B2
APPLICATION NO. : 12/340600
DATED : July 23, 2013
INVENTOR(S) : Polinske et al.

It is certified that error appears in the above-identified patent and that said Letters Patent is hereby corrected as shown below:

On the title page, in column 2, Item (56) under "Other Publications", line 1, after "11/357,751", insert --,--, therefor On title page 2, in column 2, Item (56) under "Other Publications", line 3, after "11/357,751", insert --,--, therefor On title page 2, in column 2, Item (56) under "Other Publications", line 7, delete "Mailed" and insert --mailed--, therefor On title page 2, in column 2, Item (56) under "Other Publications", line 11, delete "mailed" and insert --filed--, therefor On title page 2, in column 2, Item (56) under "Other Publications", line 17, delete "W T," and insert --W. T.,--, therefor On title page 2, in column 2, Item (56) under "Other Publications", line 29, delete "12/340,604 ," and insert --12/340,604,--, therefor On title page 2, in column 2, Item (56) under "Other Publications", line 49, delete "12/340,604 ," and insert --12/340,604,--, therefor On title page 2, in column 2, Item (56) under "Other Publications", line 51, delete "Mailed" and insert --mailed--, therefor On title page 2, in column 2, Item (56) under "Other Publications", line 59, delete "12/638,720 ," and insert --12/638,720,--, therefor Signed and Sealed this
Eleventh Day of November, 2014

Michelle K. Lee

Michelle K. Lee
*Deputy Director of the United States Patent and Trademark Office*

In the Claims

In column 10, line 39, in Claim 4, before “the”, insert --of--, therefor

In column 10, line 58, in Claim 10, delete “claim 1” and insert --claim 1,--, therefor In column 12, line 1, in Claim 23, delete “claim 3 ,wherein” and insert --claim 3, wherein--, therefor In column 12, line 20, in Claim 27, delete “antennal” and insert --antenna--, therefor